United States Patent [19]

Oudet et al.

[11] 4,238,935

[45] Dec. 16, 1980

[54] METHOD FOR MANUFACTURING A CHAIN FROM THE VERTEBRA OF AN ANIMAL

[76] Inventors: Paul-Marie B. Oudet, Avenue Marcellin Poncet, 84560 Menerbes; Jean-Marie P. Oudet, Tour Athenes 75, rue du Javelot, 75645 Paris, both of France

[21] Appl. No.: 934,164

[22] Filed: Aug. 16, 1978

[30] Foreign Application Priority Data

Aug. 23, 1977 [FR] France ..... 77 25685
Apr. 17, 1978 [FR] France ..... 78 11229

[51] Int. Cl.[3] ..... A44C 11/00; F16G 13/00

[52] U.S. Cl. ..... 63/2; 29/160.6; 29/433; 59/35 R; 59/78.1; 59/80; 434/274

[58] Field of Search ..... 29/160.6, 241, 433; 59/35, 78, 78.1, 80, 82; 35/17, 20; 63/2, 3; 3/1.9, 1.91

[56] References Cited

U.S. PATENT DOCUMENTS

| | | | |
|---|---|---|---|
| 983,547 | 2/1911 | Fleck | 35/17 |
| 1,276,117 | 8/1918 | Riebe | 59/78.1 |
| 1,581,736 | 4/1926 | Hassler | 35/17 |
| 1,668,359 | 5/1928 | Doty | 59/78 |
| 2,472,819 | 6/1949 | Giesen | 35/17 |
| 3,335,428 | 8/1967 | Gajdos | 35/17 |

OTHER PUBLICATIONS

Latham, A., "Replaceable You", printed in *New York,* issue of Feb. 10, 1975, p. 37.

*Primary Examiner*—F. Barry Shay
*Attorney, Agent, or Firm*—Parmelee, Miller, Welsh & Kratz

[57] ABSTRACT

The invention relates to a method for manufacturing a chain or the like, particularly for ornamental use, wherein modules are made from one or more vertebrae taken from the vertebral column of an animal, presenting the same type of articulation as the original vertebra and these modules are fitted in one another in the manner of the natural vertebral column with the aid of assembly means. The modules may be strung on a supple cord, or may be formed to be connectable by integral means. The cire perdue method may be used to produce any desired number of modules from a vertebra. Vertebrae of different sizes may be used to produce a chain of links of varying size.

16 Claims, 7 Drawing Figures

METHOD FOR MANUFACTURING A CHAIN FROM THE VERTEBRA OF AN ANIMAL

The present invention relates to a method for manufacturing a chain or the like, particularly for ornamental use.

Numerous methods for obtaining chains or the like having the character of jewelry are known. Apart from the traditional necklaces composed of pearls, beads or the like threaded successively, chains and like chain bracelets are made from metals, composed of links of variable shapes, connected together. Chains of circular sections are also known, constituted by the imbrication of repetitive geometrical motifs. Once the constituent elements have been manufactured, the setting of these products is relatively long or require the use of a special tool, which is expensive.

It is an object of the present invention to provide a method for manufacturing a novel type of chain, of which the elements fit into one another by their very shape without losing the suppleness inherent in a chain.

In fact, the present invention relates to a method for manufacturing a chain or the like, particularly for ornamental use, wherein, from a vertebra taken from the vertebral column of an animal, modules are produced on a variable scale presenting the same type of surface of articulation as the original vertebra and these modules are fitted in one another in the manner of the natural vertebral column with the aid of means for assembling said modules, means being provided to maintain these modules fitted in one another.

In a particularly advantageous embodiment, the assembling element is constituted by a supple cord on which the modules are threaded.

The modules derived from the original vertebra are advantageously obtained by casting, this allowing easy manufacture. The methods used are either included in the casting domain, using, for example, the techniques of investment casting, or cire perdue, and of injection, or in the domain of forging, using for example the techniques of stamping and dieing. The investment casting, or cire perdue technique, known per se, consists in taking the impression of the original vertebra with the aid of an adequate rubbery paste. The first mould makes it possible, by casting wax therein, to obtain a first replica of the original vertebra. This replica is then taken in a second mould made of refractory material, for example cement, which then allows the simple reproduction of the initial model by casting molten metal which takes the place of the wax previously evacuated by baking. The method of stamping may also be used which allows a much greater mass production. In this case, a specialised workman reproduces in a piece of mild steel the characteristics of the original vertebra, possibly choosing a scale different from 1; it then suffices to quench the two parts of the mould thus made to obtain a die allowing, with the aid of a press, the reproduction in series of the desired model. Depending on the material used, one may, of course, work hot or cold.

According to another aspect of this embodiment, it will be noticed that the supple cord used for constituting the chain may advantageously pass in the channel constituted by the juxtaposition of the "vertebral holes" of the modules.

In addition, according to the desired use, the material of the modules may be chosen from different strong materials such as metals, precious or not, glass, plastics material, rubber and the like.

According to another feature of the invention, the means provided for maintaining the modules imbricated in one another are advantageously realised by regularly fixing a module to the supple cord. The method used will depend on the materials used. In the case of a metal, welding proves to be highly advantageous; for example the welding of one module out of ten is recommended.

It goes without saying that the outer shape of the original vertebra may be previously altered purely for aesthetic reasons or for the pleasantness of contact. Thus, it may be advantageous to remove the spinous process located on one of the faces of the vertebra whilst the possible points of fixation of the ribs on said vertebra will be removed. These operations, which may be effected by grinding, are intended to enable a chain of regular shape and pleasant to the touch to be obtained. Similarly, it may prove very advantageous to constitute a chain with modules obtained from different original vertebrae, with a view, for example, to obtaining a gradual diffference in shape of said chain.

Finally, it should be noted that an ophidian vertebra gives a particularly homogeneous chain having, in addition, a direction of least suppleness, corresponding to one of the faces of the vertebra, this "rigidity" allowing a virtually unvariable positioning on the wrist or around the neck when said chain is worn as bracelet or as necklace.

Although the mode of assembling by supple cord is perfectly satisfactory, it may be advantageous, in certain cases, to resort to other modes of assembly; in particular, it may be advantageous if the assembly means as well as the means provided to maintain these modules fitted in one another are constituted by two assembly portions located on either side of each module and adapted to cooperate with corresponding portions of contiguous module in order to ensure the interlocking of the modules and the maintaining of said modules interlocked. In this case, the chain according to the invention may be assembled by techniques known in the domain of chains.

The assembly portions are thus advantageously integral with the modules.

Of course, the modules may be prepared by any one of the techniques described hereinabove, particularly casting which lends itself well to obtaining modules comprising assembly portions integral therewith by casting or by stamping.

When producing the assembly portions, the shape from which the desired module derives should be kept in mind so that it preferably conserves the contours of the original shape. This is why the assembly portions will preferably be constituted, at least partially, by removal of material with respect to the vertebra taken.

Of course, the production of the assembly portions must be such that it conserves the suppleness of the chain obtained, for example by providing a certain clearance between two contiguous assembly portions.

Thus, one of the assembly portions may be provided to be in the form of a clip which is folded down on a corresponding portion of the contiguous module to ensure interlocking.

This method is particularly advantageous when the material constituting the chain is ductile.

However, it may be provided that the two corresponding portions of contiguous module be force-fitted by elastic deformation of said parts.

The method is particularly advantageous when the material constituting the chain is elastic (for example synthetic polymer).

This method, although it does not require the use of a supple cord for fitting the modules, does not exclude the presence of such a cord, but in this case, it may be not only "supporting" but also, if desired, "supported". In fact, the chain formed by the method according to the invention may constitute to a certain extent a protective "tube" in which a cord to be protected may be placed.

The modules proposed for carrying out the method are, of course, part of the present invention.

The result of the present invention will be more readily understood on reading the following description supported by the accompanying drawing which show metal replicas of ophidian vertebrae produced by the investment casting or cire perdue technique and intended to be assembled on a supporting cord.

BRIEF DESCRIPTION OF THE DRAWING

FIG. 1 shows several metal replicas of an ophidian vertebra 1 imbricated in one another in the same manner as on the original vertebral column. The left-hand replica 1', slightly apart, and of which the anterior or ventral face is seen, possesses, on either side of the socket 3 adapted to receive the "ball" of a preceding replica, two flecked zones 5 corresponding to the traces of the points of fixation of the ribs which have been eliminated in order to obtain a particularly smooth and aesthetic chain.

Figure 1:
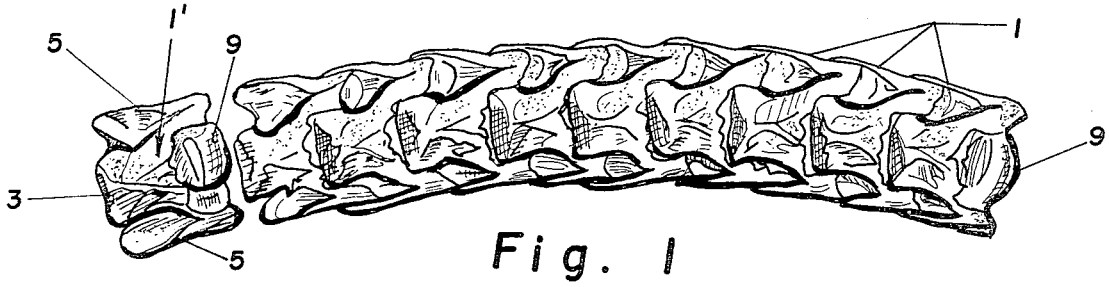
FIG. 1 is a bottom plan view illustrating several replicas of an orphidian vertebra aligned for assembly all in accordance with the invention.
Figures 2A, 2B, 2C, 2D, 2E:
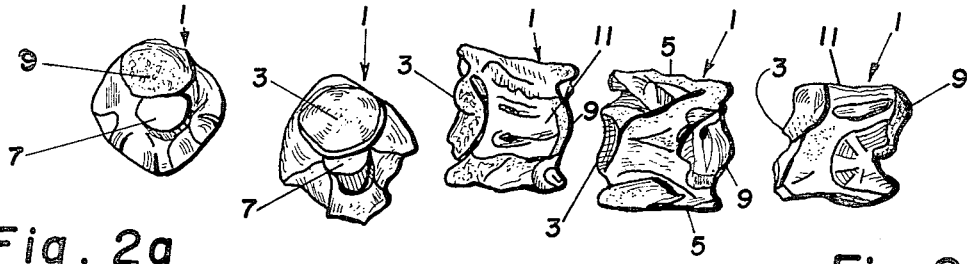
FIG. 2*a* is a front elevation of an orphidian vertebra.
FIG. 2*b* is a rear elevation of an orphidian vertebra.
FIG. 2*c* is a top plan view of an orphidian vertebra.
FIG. 2*d* is a bottom plan view of an orphidian vertebra.
FIG. 2*e* is a side elevation of an orphidian vertebra.

An individual vertebra 1 is illustrated in the several views presented in FIGS. 2*a* through 2*e* in which the socket 3, the flecked zones 5, the vertebra hole 7, and the ball 9 can be clearly seen. On the dorsal side or top of each vertebra 1, as in FIGS. 2*c* and 2*e* is a protuberance 11 which corresponds to the base of the spinous process which was previously removed so that the chain obtained does not present any roughness which may catch on the wearer's clothes.

Figure 3:
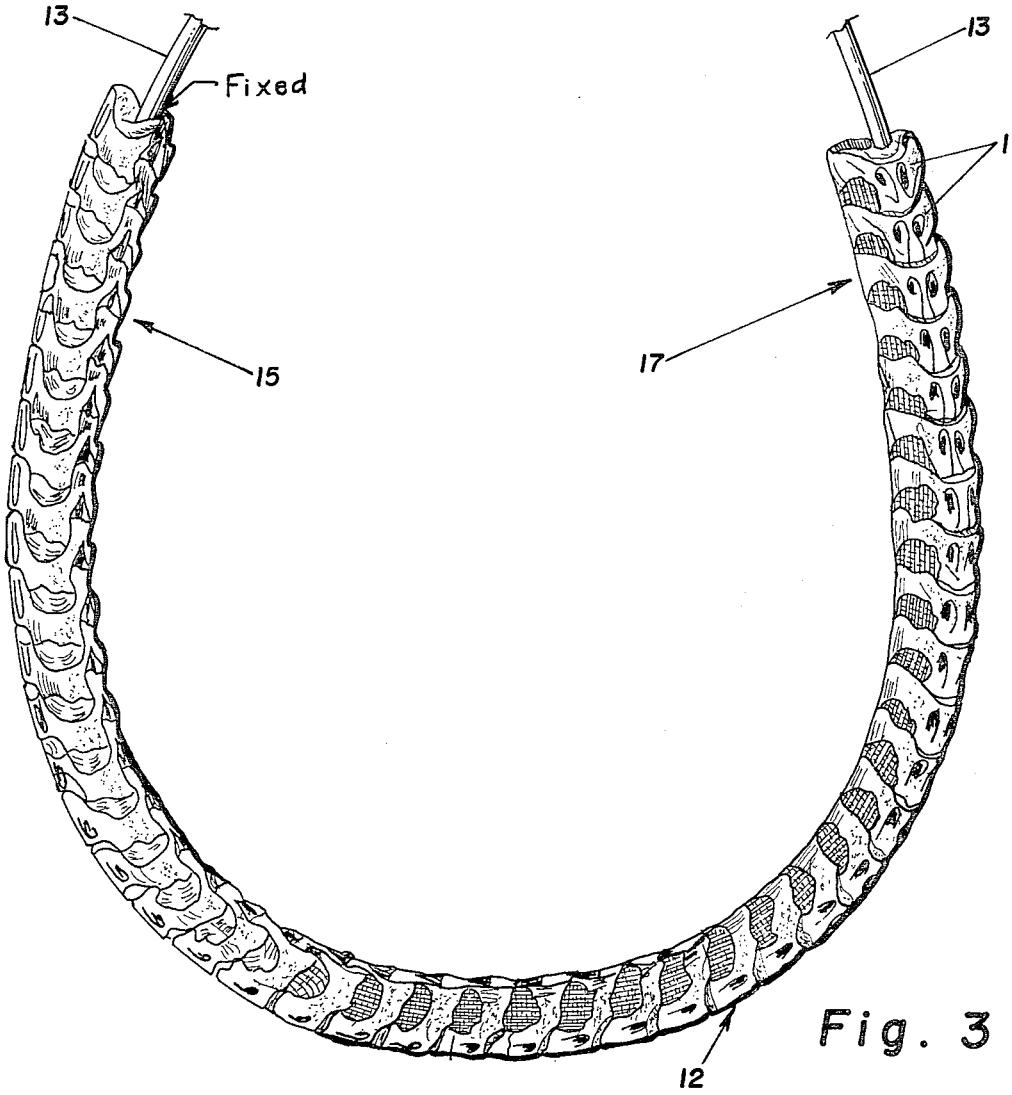
FIG. 3 illustrates a chain manufactured according to the method of the invention.

FIG. 3 mainly shows a chain 12 manufactured according to the method of the invention. On each side of this "necklace", the supple cord 13 may be seen on which the replicas are mounted. In this case, the supple cord, made of leather, takes the channel constituted by the juxtaposition of the "vertebral holes 7". In addition, on the left-hand part 15 of the chain are noted the anterior faces of the replicas which correspond here to a direction of rigidity since their "balls" are locked in the socket of the following replica. Little by little, towards the right-hand part 17 of the chain, the chain twists and the lateral side of the replicas is seen. It should be noted that the direction of curvature of the chain corresponds mainly to a bending along the posterior or dorsal face of the replicas, this direction being privileged as regards the suppleness of the articulations. It should, however, be noted that this privileged direction may vary according to the origin of the vertebra chosen.

A supple and strong chain or the like, which may receive both ornamental and technical applications, is obtained by this method.

It is obvious that the present invention is not limited to the embodiments which have been described hereinabove and illustrated, but that it extends to all variants thereto in accordance with the spirit thereof.

What is claimed is:

1. In a method for manufacturing a chain, particularly for ornamental use, the steps of:

taking a vertebra from an original vertebral column of an animal, removing the projecting parts including the spinous process and the points of fixation of the ribs from said vertebra to give the vertebra a regular shape to form a vertebra module, reproducing the so obtained vertebra module, said reproduced modules conserving the surfaces of articulation of the original vertebra, and fitting these reproduced modules in one another in the manner of the original vertebral column, and joining them by means of a supple cord on which said reproduced modules are threaded to maintain these modules fitted to one another.

2. The method of claim 1, wherein the supple cord passes in the channel constituted by the juxtaposition of the "vertebral holes" of the modules.

3. The method of claim 1, wherein an ophidian vertebra is used, the chain thus formed possessing a direction of least suppleness on the anterior side of the vertebra, that allows positioning, particularly on the wrist or around the neck when said chain is worn as bracelet or as necklace.

4. The method of claim 1, wherein the material used for reproducing the modules is a plastics material.

5. The method of claim 1, wherein the material used for reproducing the modules is a plastics material.

6. The method of claim 1 wherein such reproduced modules are in a size different from the original vertebra.

7. The method of claim 1, wherein the reproduced modules are obtained by casting the original vertebra by investment casting.

8. The method of claim 1 wherein the reproduced modules are obtained by casting the original vertebra by injection.

9. The method of claim 1 wherein the reproduced modules are obtined by the method of stamping.

10. The method of claim 1 wherein the reproduced modules are manufactured by the method of dieing.

11. The method of claim 1, including fixing one of the reproduced modules to the supple cord to maintain the reproduced modules on the cord.

12. The method of claim 11 wherein said cord is metallic and said one of said reproduced modules is welded to the cord.

13. The method of claim 12, wherein the material used for reproducing the modules is a precious metal.

14. The method of claim 12, wherein the material used for reproducing the modules is a non-precious metal.

15. A chain obtained by the method of claim 1.

16. The chain of claim 15, including reproduced modules obtained from more than one original vertebra, with said chain having a gradual difference in shape.

* * * * *